United States Patent [19]

Okazaki Tasuku

[11] 3,964,010

[45] June 15, 1976

[54] SIMPLE, SMALL-SIZED FUSE

[76] Inventor: Okazaki Tasuku, 353-81, Nishi 3-chome, Nakayama-cho, Nara, Japan

[22] Filed: Oct. 8, 1974

[21] Appl. No.: 513,165

[30] Foreign Application Priority Data

Mar. 16, 1974 Japan ..... 49-30726

[52] U.S. Cl. ..... 337/148; 337/408

[51] Int. Cl.[2] ..... H01H 71/20

[58] Field of Search ..... 337/10, 148, 198, 408; 339/252; 200/61.48; 174/52 PE

[56] References Cited

UNITED STATES PATENTS

| | | | |
|---|---|---|---|
| 1,693,404 | 11/1928 | Sandin | 337/148 X |
| 2,615,857 | 10/1952 | Clarke | 174/52 PE |
| 2,844,769 | 7/1958 | Erkelens et al. | 174/52 PE |
| 2,857,560 | 10/1958 | Schnable et al. | 174/52 PE |
| 2,955,179 | 10/1960 | Milton et al. | 337/408 X |

*Primary Examiner*—Mark O. Budd
*Assistant Examiner*—Fred E. Bell
*Attorney, Agent, or Firm*—Wenderoth, Lind & Ponack

[57] ABSTRACT

A small-sized fuse comprising lead wires supported in parallel by a heat-resisting and insulating support, a conductor bridging said lead wires with its both ends fixed to said lead wires by alloy of low fusing point, a heat-resisting elastic substance pressed against said conductor so that said conductor is urged to separate from said lead wires upon fusing of said alloy of low fusing point and a frame in which insulating filler such as insulating grease is filled.

3 Claims, 4 Drawing Figures

SIMPLE, SMALL-SIZED FUSE

This invention relates to a small fuse which blows at the fixed temperature to break a circuit. More particularly, this invention provides a simple, small fuse comprising two lead wires supported in parallel by a heat-resisting, insulating support which is covered with a frame. A conductor bridges said lead wires with both ends fixed to each lead wire by an alloy having a low fusing point, and a heat-resisting elastic substance is urged to upward against said conductor so that upon fusing of said alloy of low fusing point the conductor is freed from connection with said lead wires and the insulating filler, such as insulating grease, in the frame.

The complete nature and full advantage of the present invention will be understood more clearly from the description made with reference to the attached drawings in which.

Figure 1:
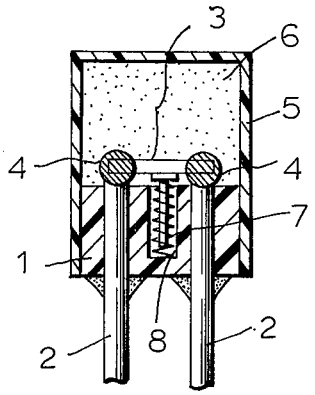
FIG. 1 is a longitudinal section of the fuse according to the present invention in its normal state.
Figure 2:
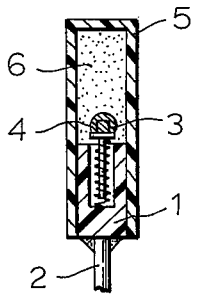
FIG. 2 is a side elevation of the fuse shown in FIG. 1, cut vertically.

In the drawing, a support 1 is made of highly insulative and heat resistive material. This support 1 is covered by a frame 5 made of insulative and heat-resistive material in such a fashion as to form a hermetically sealed chamber. Two lead wires 2, 2 are led, in parallel with each other, into the frame 5 with a fixed space therebetween and are fixed to the support 1. Said lead wires should be good conductors, such as copper or silver-plated wires, and are supported hermetically by the support 1 at the led-in portion or the other portion with a binder, such as epoxy resin. A conductor 3 is provided in such a fashion that it makes contact with the end portion of each lead wire within the frame 5, and contact points 4, 4 between the conductor and the two lead wires are fixed together by an alloy having a low fusing point comprising an eutectic compound. Insulative filler, such as grease, is filled into the frame. This insulative filler is intended to prevent oxidation of the alloy and to withstand the voltage between the two lead wires after fusing. Therefore, special grease 6 which is highly heat resistive and insulative is used as filler. In order to separate the conductor 3 from the lead wires sensitively, in other words, in order to make the fuse according to the present invention operate competently as soon as the alloy reaches its own fusing point, a heat resistive and elastic coiled spring 7 is inserted into a concave opening 8 in the support 1 and is compressed so that it is urged upward against the conductor 3. In this connection, if the head of the coiled spring is covered with a cap member 9 of rivet-shape, it will make smooth the slipping of the coiled spring in and out of the concave 8.

Figure 3:
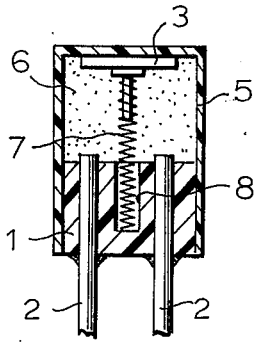
FIG. 3 is the fuse according to the present invention as operated.
Figure 4:
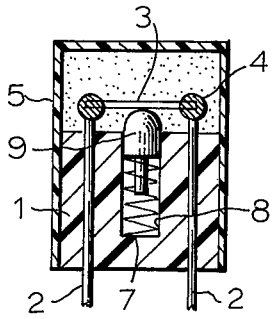
FIG. 4 shows the fuse according to the present invention, in which a cap member is placed on a coiled spring.

According to the present invention, the fuse in its normal state is stable as shown by FIG. 1, and if the alloy of low fusing point fuses, the elasticity of the compressed coiled spring 7 instantly separates the conductor 3 from lead wires 4. At the same time, the circuit is broken, as shown by FIG. 3. This performance of the coiled spring, together with the insulating effect of the insulating grease filled in the frame, checks the occurrence of trouble due to re-connecting of the conductor with the lead wires.

The fuse according to the present invention is, therefore is simple in construction, sensitive in operation, and involves no fear of re-connecting after being blown. Thus, the fuse according to the present invention can be used safely.

What I claim is:

1. A fuse comprising:

a casing frame having one open side;

a heat resistant and insulative support base fitted into said open side;

a plurality of parallel lead wires fitted through said support base and held thereby in a stationary position with one end of each wire inside said casing and one end exposed outside of said casing;

conductive bridging means between said parallel wires for conductively connecting said lead wires to each other;

low temperature fusing means at the connecting points of said bridging means and said lead wires for fusibly joining said bridging means to said wires;

heat resistive biasing means fitted into said support base and biased against said bridging means for urging said bridging means away from said wires when said low temperature fusing means is fused; and an anti-oxidant insulative filler filling the open space within said casing and surrounding said bridging means, fusing and biasing means.

2. A fuse as claimed in claim 1 wherein said filler is comprised of insulating grease.

3. A fuse as claimed in claim 1 wherein said biasing means is a coiled spring forced against said bridging means.

* * * * *

UNITED STATES PATENT OFFICE

CERTIFICATE OF CORRECTION

Patent No. 3,964,010 Dated June 15, 1976

Inventor(s) TASUKU OKAZAKI

It is certified that error appears in the above-identified patent and that said Letters Patent are hereby corrected as shown below:

On the cover sheet, line [76] should read:

Inventor: "Tasuku Okazaki, 353-81, Nishi 3-chome, Nakayama-cho, Nara, Japan"

Signed and Sealed this

Thirty-first Day of August 1976

[SEAL]

*Attest:*

RUTH C. MASON
*Attesting Officer*

C. MARSHALL DANN
*Commissioner of Patents and Trademarks*